United States Patent [19]

Neyret

[11] Patent Number: 5,044,183

[45] Date of Patent: Sep. 3, 1991

[54] SECURING LOCK MECHANISM HAVING A DISENGAGEABLE CONTROL DEVICE

[75] Inventor: Guy Neyret, Oullins, France

[73] Assignee: Neiman S. A., Courbevoie, France

[21] Appl. No.: 148,165

[22] Filed: Jan. 21, 1988

Related U.S. Application Data

[63] Continuation of Ser. No. 684,800, Dec. 21, 1984, abandoned.

[30] Foreign Application Priority Data

Dec. 28, 1983 [FR] France ..... 83 20907

[51] Int. Cl.[5] ..... E05B 9/08

[52] U.S. Cl. ..... 70/223; 70/370; 70/380; 70/379 R

[58] Field of Search ..... 70/222-224, 70/379 R, 379 A, 380, 370, 451; 292/336.3, DIG. 27, DIG. 37

[56] References Cited

U.S. PATENT DOCUMENTS

| | | | |
|---|---|---|---|
| 2,697,342 | 12/1954 | McConnell et al. | 70/224 |
| 3,065,623 | 11/1962 | Regan | 70/379 R |
| 3,649,061 | 3/1972 | Meyers | 292/DIG. 27 |
| 3,872,697 | 3/1975 | Wellekens | 70/370 |
| 4,100,774 | 7/1978 | Solovieff et al. | 70/380 |
| 4,369,642 | 1/1983 | Grell | 70/380 |
| 4,381,656 | 5/1983 | Hayakawa | 70/370 |
| 4,403,485 | 9/1983 | Scherbing | 70/379 R |
| 4,550,580 | 11/1985 | Neyret | 70/370 |

FOREIGN PATENT DOCUMENTS

| | | | |
|---|---|---|---|
| 1145513 | 3/1963 | Fed. Rep. of Germany | 70/223 |
| 2009677 | 10/1970 | Fed. Rep. of Germany | 70/379 R |

*Primary Examiner*—Vinh T. Luong
*Attorney, Agent, or Firm*—James C. Wray

[57] ABSTRACT

A lock mechanism comprises a housing and a rotor mounted within a bore of the housing having a skirt, the rotor and skirt being rotatable by a knob. A lock opening and closing lever is rotatable between locking and unlocking positions and a rod is drivably connected to the lock opening and closing lever and serves for connection to a latching device.

A securing and release lever drivably connected with the rotor through a drive tang and a slot permitting lost motion is movable by an actuator independently of the rotor.

A slider is movable in a groove in the opening and closing lever by the securing and release lever between a first position on release to effect a driving connection between the rotor and the lock opening and closing lever by engagement of the slider with an aperture in the skirt and a second position on securing to disconnect the drive between the rotor and the lock opening and closing lever by withdrawal of the slider from the aperture in the skirt and to permit the rotor and knob to rotate freely.

10 Claims, 1 Drawing Sheet

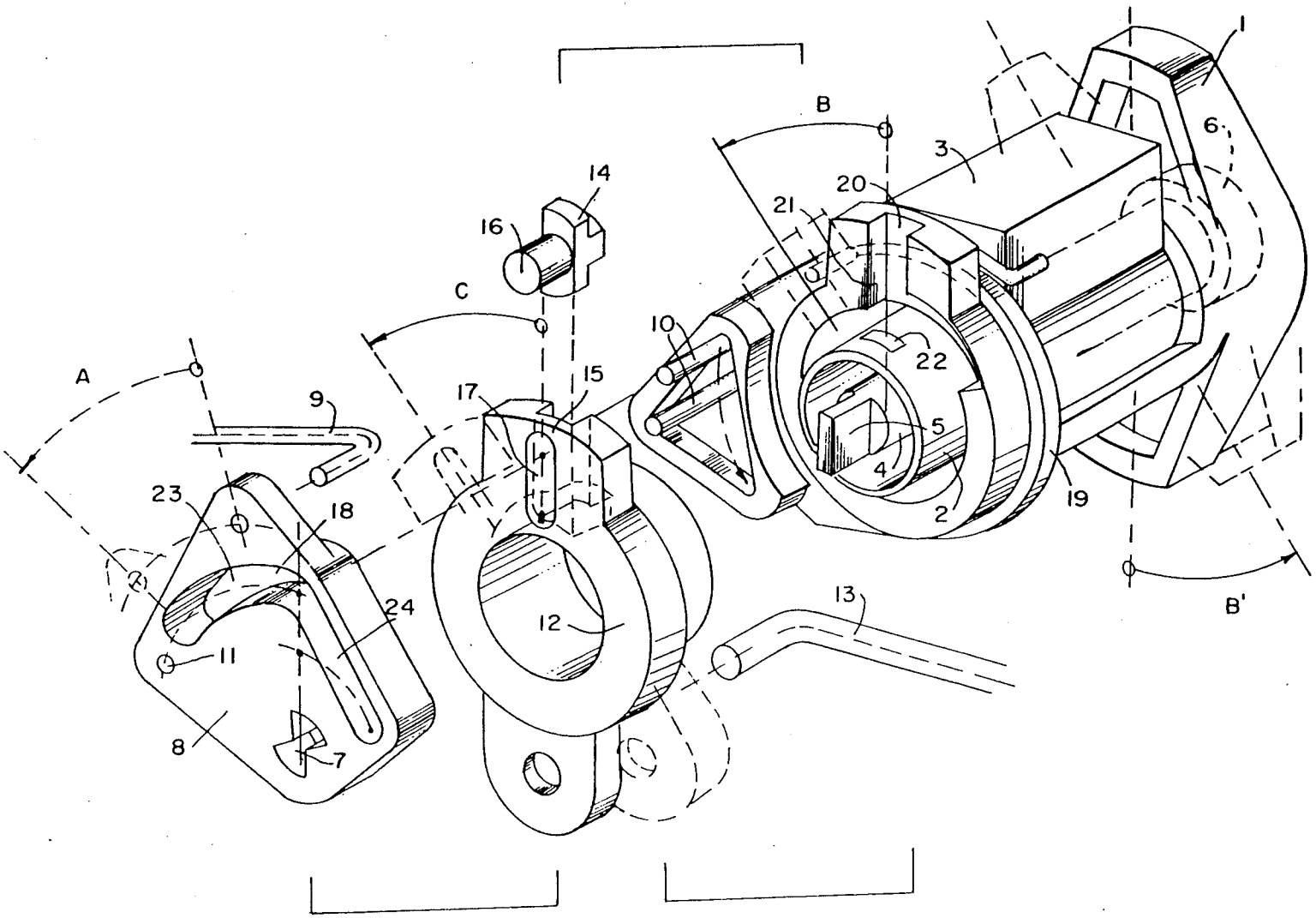
1
6
B'
19
3
22
5
2
20
4
B
21
13
10
14
15
12
16
C
17
24
9
18
7
11
23
8
A

SECURING LOCK MECHANISM HAVING A DISENGAGEABLE CONTROL DEVICE

BACKGROUND OF THE INVENTION

1. Field of the Invention

The invention relates to a securing lock mechanism of the type comprising a rotor and lever connected to the rotor for opening a latching device, a manually operable means for operating the lever, and a securing and release lever controlled by an actuator independently of the said rotor, said securing and release lever being in driving connection with the rotor by way of lost motion means.

In known devices of this type securing generally involves locking of the manually operable means which then, in the case of a break-in attempt, can be forced by a violent direct action.

2. Object of the Invention

The object of the present invention is to render the connection between the opening lever and the control knob disengageable, both by action upon the bolt and by control of the actuator, by simple, reliable and economic means.

SUMMARY OF THE INVENTION

According to the invention there is provided a lock mechanism comprising a housing having a bore therein, a rotor rotatably mounted within the bore of the housing, a lock lever rotatable between angularly spaced locking and unlocking positions, a lock actuating element drivably connected to said lock lever for movement thereby into locking and unlocking positions, manually operable means attached to said rotor for rotating the latter, a securing and release lever movable between angularly spaced securing and release positions and drivably connected with said rotor through lost motion means, and an actuator for effecting movement of said securing and release lever between its securing and release positions, and a slider movable by said securing and release lever between a first position on release to effect a driving connection between the rotor and the lock lever by engagement of said slider with an aperture in the skirt and a second position on securing to disconnect the drive between the rotor and the lock lever by withdrawal of the slider to permit said rotor and manually operable means to rotate freely, said slider having a lug cooperating with a slot formed in said securing and release lever, said slot having an arcuate portion coaxial with the pivotal axis of the lock lever and a rectilinear portion contiguous with said arcuate portion, whereby with the securing and release lever in the release position the lug moves along the arcuate portion of the slot on rotation of said securing and release lever but is not displaced along said slot and on movement of said securing and release lever into the securing position thereof the lug is displaced along the slot by reaction of the lug with the rectilinear portion of the slot as the securing and release lever is rotated.

BRIEF DESCRIPTION OF THE DRAWING

The invention will now be described by way of example with reference to the accompanying drawing, which shows a diagrammatic exploded perspective view of the lock mechanism.

DESCRIPTION OF PREFERRED EMBODIMENTS

The lock mechanism comprises an operating knob 1 cast with a cylindrical skirt 2 rotatable within a housing 3. A bolt rotor 4 terminating in a drive tang 5, is mounted coaxially with the skirt 2 and comprises a head 6 flush with the external surface of the knob 1 for the introduction of a control key (not shown).

The drive tang 5 of the rotor 4 is in engagement in a slot 7, with angular play permitting lost motion, of a securing and release lever 8 mounted for pivoting on one extremity of an actuating rod 9 connected at its other extremity to an electric or pneumatic actuator (not shown). A bistable spring 10 lodged in known manner in the casing 3 co-operates with a bore 11 of the lever 8 to ensure two stable positions of this lever.

A lock opening lever 12 is mounted freely on the skirt 2 between the casing 3 and the lever 8. A lock actuating rod 13, connected to a latching device (not shown) is articulated to the lever 12.

In accordance with the invention an engagement slider 14 is mounted for sliding in a groove 15 of the opening lever 12. The slider 14 comprises a lug 16 which protrudes towards the lever 8 and slides in a slot 17 of the lever 12 and the extremity of which co-operates with a guide slot 18 formed in the lever 8. A spring 19 returns the opening lever 12 into the closure position.

The housing 3 comprises an engagement groove 20 disposed to complement the groove 15 in the closure position of the lever 12 and in which the slider 14 is lodged in the securing position. A face 21 of the groove 20 forms a stop for the opening lever 12 in the closure position. The skirt 2 comprises an aperture 22 situated in extension of the grooves 12 and 20 in the closure position of the lever 12. The groove 18 of the lever 8 comprises an arcuate portion 23 prolonged by a rectilinear portion 24.

The manner of operation of the device is as follows. In the unsecured closure position the lug 16 of the slider 14 is lodged in the groove 18 of the lever 8, in the zone of connection between the groove portions 23 and 24. A pull upon the actuator rod 9 produces a securing rotation of the lever 8 through the angle A. The lug 16 is guided in the rectilinear portion 24 of the groove 18, producing an upward displacement of the slider 14 which leaves the aperture 22. The opening lever 12 is no longer in driving connection with the skirt 2 and the opening knob 1 rotates idly. Moreover the slider 14 is lodged at least partially in the groove 20 of the casing 3, opposing any attempt at a break-in by action upon the rod 13 or the lever 12. The angular play of the slot 7 permits the rotation A despite the presence of the tang 5 of the rotor 4.

Starting from the preceding unsecured position, a rotation of the skirt 2 (rotation B' of the knob 1) through the angle B leads to the same unsecured position by co-operation of the tang 5 of the rotor 4 with the slot 7 of the lever 8.

In the unsecured position the slider 14 is lodged in the aperture 22 and is free of the groove 20 of the casing 3. Thus the opening lever 12 is in driving connection with the skirt 2 and the rotor 4. A rotation of the opening lever 12 through an angle C, by a corresponding rotation of the rotor 4, causes a thrust upon the rod 13 and effects opening of the latching device. During this rotation of the lever 12 through the angle C the lug 16 of the slider 14 moves in the arcuate portion 23 of the groove 18, which is concentric with the whole of the mechanism, so that the lever 8 is not rotated.

I claim:

1. A lock mechanism comprising a) a housing, b) a rotor mounted within a bore of the housing, c) a lock opening lever rotatable between angularly spaced locking and unlocking positions, d) a lock actuating element drivably connected to said lock opening lever for movement thereby into locking and unlocking positions, e) manually operable means attached to said rotor for rotating the rotor, f) a securing and release lever movable between angularly spaced securing and release positions and drivably connected with said rotor through lost motion means, g) an actuator for effecting movement of said securing and release lever between its securing and release positions independently of said rotor, h) a skirt attached to said rotor so as to be rotatable therewith, and i) a slider movable by said securing and release lever between a first position on release to effect a driving connection between the rotor and the lock opening lever by engagement of said slider with an aperture in the skirt and a second position on securing to disconnect the drive between the rotor and the lock opening lever by withdrawal of the slider from the aperture in the skirt and to permit said rotor and manually operable means to rotate freely, wherein the slider comprises a lug cooperating with a slot formed in said securing and release lever, said slot having an arcuate portion coaxial with the pivotal axis of the lock opening lever and a rectilinear portion contiguous with said arcuate portion.

2. A lock mechanism according to claim 1, wherein the rotor, manually operable means, the lock opening lever and the securing and release lever are all rotatable about a common axis.

3. A lock mechanism, comprising a) a housing having a bore therein, b) a rotor mounted within the bore of the housing, c) a cylindrical skirt fast in rotation with the rotor, d) a lock lever rotatable between angularly spaced locking and unlocking positions, e) a lock actuating element drivably connected to said lock lever for movement thereby into locking and unlocking positions, f) manually operable means attached to said rotor for rotating the rotor, g) a securing and release lever movable between angularly spaced securing and release positions and drivably connected with said rotor through lost motion means, h) an actuator for effecting movement of said securing and release lever between its securing and release positions, and i) a slider movable by said securing and release lever between a first position on release to effect a driving connection between the rotor and the lock lever by engagement of said slider with an aperture in the skirt and a second position on securing to disconnect the drive between the rotor and the lock lever by withdrawal of the slider from the aperture in the skirt and to permit said rotor and manually operable means to rotate freely, j) said slider having a lug cooperating with a slot formed in said securing and release lever, said slot having an arcuate portion coaxial with the pivotal axis of the lock lever and a rectilinear portion contiguous with said arcuate portion, such that when the securing and release lever are in the release position the lug moves along the arcuate portion of the slot on rotation of said securing and release lever, and on movement of said securing and release lever into the securing position thereof the lug is displaced along the slot by reaction of the lug with the rectilinear portion of the slot as the securing and release lever is rotated.

4. A securing lock mechanism comprising a housing, a rotor mounted within the housing, an opening lever rotatable between angularly spaced end positions, a rod drivable into locking and unlocking positions by said opening lever, manually operable means attached to said rotor for rotating the rotor, a securing and release lever movable between angularly spaced end positions drivably connected with said rotor by lost motion means, and an actuator for effecting movement of said securing and release lever between its end positions independently of said rotor, a slider which is movable between a first position to effect a driving connection between the rotor and the securing and release lever and a second position to disconnect the drive between the rotor and the securing and release lever.

5. A lock mechanism according to claim 4, wherein said slider is movable in said housing and the manual operable means rotates freely when the lock mechanism is in the secured position.

6. A lock mechanism according to claim 4, wherein said slider cooperates, in the unsecured position, with an aperture of a skirt fixed with the manual operable means.

7. A lock mechanism according to claim 4, wherein said slider comprises a lug cooperating with a slot of the said securing and release lever, the said slot having an arcuate portion coaxial with the opening lever and prolonged by a rectilinear portion.

8. A lock mechanism according to claim 4, wherein the manually operable means, the opening lever and the securing and release lever are coaxial.

9. A securing lock mechanism comprising a housing, a rotor mounted within the housing, an opening lever rotatable between angularly spaced end positions, a rod drivable into locking and unlocking positions by said opening lever, manually operable means attached to said rotor for rotating the rotor, a securing and release lever movable between angularly spaced end positions drivably connected with said rotor by lost motion means, and an actuator for effecting movement of said securing and release lever between its end positions independently of said rotor, a slider which is movable between a first position to effect a driving connection between the rotor and the securing and release lever and a second position to disconnect the drive between the rotor and the securing and release lever, wherein said slider cooperates, in the unsecured position, with an aperture of a skirt fixed with the manual operable means.

10. A securing lock mechanism comprising a housing, a rotor mounted within the housing, an opening lever rotatable between angularly spaced end positions, a rod drivable into locking and unlocking positions by said opening lever, manually operable means attached to said rotor for rotating the rotor, a securing and release lever movable between angularly spaced end positions drivably connected with said rotor by lost motion means, and an actuator for effecting movement of said securing and release lever between its end positions independently of said rotor, a slider which is movable between a first position to effect a driving connection between the rotor and the securing and release lever and a second position to disconnect the drive between the rotor and the securing and release lever, wherein the slider comprises a lug cooperating with a slot formed in said securing and release lever, said slot having an arcuate portion coaxial with the pivotal axis of the lock opening lever and a rectilinear portion contiguous with said arcuate portion.

* * * * *